United States Patent [19]

Honma

[11] Patent Number: 4,681,069

[45] Date of Patent: Jul. 21, 1987

[54] OVERHEAD CAMSHAFT ENGINE

[75] Inventor: Masayuki Honma, Yokohama, Japan

[73] Assignee: Nissan Motor Co., Ltd., Yokohama, Japan

[21] Appl. No.: 777,426

[22] Filed: Sep. 18, 1985

[30] Foreign Application Priority Data

Sep. 21, 1984 [JP] Japan ..... 59-198137

[51] Int. Cl.[4] ..... F01L 1/46

[52] U.S. Cl. ..... 123/90.27; 123/90.6; 123/193 CH

[58] Field of Search ..... 123/90.27, 90.6, 193 CH

[56] References Cited

U.S. PATENT DOCUMENTS

| | | | |
|---|---|---|---|
| 4,430,968 | 2/1984 | Futakuchi et al. | 123/90.27 |
| 4,497,289 | 2/1985 | Bortolussi | 123/90.27 |
| 4,534,325 | 8/1985 | Tanaka | 123/90.27 |
| 4,537,166 | 8/1985 | Kimura et al. | 123/90.27 |

FOREIGN PATENT DOCUMENTS

| | | | |
|---|---|---|---|
| 0061778 | 10/1982 | European Pat. Off. . | |
| 3009302 | 9/1980 | Fed. Rep. of Germany | 123/90.27 |
| 57-2409 | 1/1982 | Japan . | |
| 1017038 | 1/1966 | United Kingdom . | |
| 1377866 | 12/1974 | United Kingdom . | |

*Primary Examiner*—Ira S. Lazarus

*Attorney, Agent, or Firm*—Schwartz, Jeffery, Schwaab, Mack, Blumenthal & Evans

[57] ABSTRACT

Camshafts are arranged so close as to lap in part over head bolts and formed with cuts at portions where they lap over the head bolts.

5 Claims, 9 Drawing Figures

OVERHEAD CAMSHAFT ENGINE

BACKGROUND OF THE INVENTION

1. Field of the Invention

The present invention relates to overhead camshaft engines, particularly double overhead camshaft (DOHC) engines wherein two camshafts are disposed over the cylinder head of an engine.

2. Description of the Prior Art

A valve operating device including two camshafts disposed over the cylinder head of an engine is well known in the art as is disclosed in the Japanese Provisional Patent Publication No. 57-2409 and also shown in FIGS. 8 and 9.

Referring to FIGS. 8 and 9, indicated by the reference numeral 1 is a cylinder head, and over the cylinder head 1 there are disposed two camshafts 2, 3 which are parallel to each other and rotatably supported by bearings 4, 5. The camshafts 2, 3 are driven by a timing belt (not shown) or the like in such a manner as to be rotatable in timed relation to revolution of an engine. The camshafts 2, 3 are respectively formed with cams 8, 9 for actuation of intake valves 6 and exhaust valves 7. In the example shown, each cylinder of the engine is provided with two intake valves 6 and two exhaust valves 7. Due to this, the camshafts 2, 3 are respecively provided with two cams 8, 9 in such a manner as to interpose therebetween the bearings 4, 5.

Indicated by the reference numeral 10 are valve lifters for the intake and exhaust valves 6, 7 and by 11 are valve springs for same. When the camshafts 2, 3 rotate, the valve lifters 10 are pushed by the cams 8, 9 against the springs 11, causing the intake and exhaust valves 6, 7 to open at a predetermined timing.

In the above described valve operating device, it is desirable to arrange the two camshafts 2, 3 as close as possible to each other for thereby making the included angle $\theta$ between the axes of the intake and exhaust valves 6, 7 as small as possible. Reduction in the included angle $\theta$ contributes to reduction in the surface area of a combustion chamber 12 since the intake and exhaust valves 6, 7 constitute in part the wall of the combustion chamber 12, whereby to make it possible to improve the combustion efficiency. A large included angle $\theta$ results in a large inclination of the ceiling wall of the combustion chamber 12 and an increased surface area of same and a reduced combustion efficiency.

When, however, to arrange the two camshafts 2, 3 closer to attain a small includedc angle $\theta$, there arises a problem of the interference between the fastening members for fastening the cylinder head 1 to the cylinder block 13 and the camshafts 2, 3, i.e., between the head bolts 14 and the camshafts 2, 3. For this reason, it has been impossible to reduce the distance between the two camshafts 2, 3 to a satisfactory extent. The minimum distance between the two camshafts 2, 3 is the sum of the distance between the axes of the head bolts 14, the diameter of the head bolt 14 and the diameter of the camshafts 2 or 3. When the distance between the two camshafts 2, 3 is reduced beyond the above mentioned sum, it becomes impossible to fasten with the head bolts 14 the cylinder head 1 to the cylinder block 13 after installation of the camshafts 2, 3 on the cylinder head 1.

For this reason, in the prior art arrangement, it has been practiced that the cylinder head 1 is first fastened to the cylinder block 13 with the head bolts 14 and thereafter the camshafts 2, 3 are disposed over the cylinder head 13 and supported by the bearings 4, 5, resulting in a poor assembling efficiency in the manufacture of the valve operating device and a poor working efficiency in the maintenance and care thereof.

SUMMARY OF THE INVENTION

In accordance with the present invention, there is provided a novel and improved overhead camshaft engine which comprises a cylinder block, a cylinder head, a fastening member for fastening the cylinder head to the cylinder block, a valve reciprocally mounted in the cylinder head, and a camshaft rotatably disposed over the cylinder head to control reciprocation of the valve. The above structure may substantially follow the conventional fashion.

In accordance with the present invention, the camshaft is so arranged, with respect to a plan view, as to lap in part over the fastening member and formed with a cut at a portion where it laps over the fastening member.

This structure is effective for overcoming the above noted disadvantages or drawbacks inherent in the prior art device.

It is accordingly an object of the present invention to provide a novel and improved overhead camshaft engine which can reduce restriction in layout of its camshaft.

It is another object of the present invention to provide a novel and improved overhead camshaft engine of the above mentioned character which makes it possible, in the case of a double overhead camshaft engine, to arrange its two camshafts closer as compared with those in the comparable prior art engine.

It is a further object of the present invention to provide a novel and improved overhead camshaft engine of the above mentioned character which can improve not only the assembling efficiency in the manufacture thereof but also the working efficiency in the maintenance and care thereof.

It is a still further object of the present invention to provide a novel and improved overhead camshaft engine of the above mentioned character which can improve the combustion efficiency.

It is a yet further object of the present invention to provide a novel and improved overhead camshaft engine of the above mentioned character which makes it possible to design its cylinder head smaller in size as compared with that in the comparable prior art engine.

BRIEF DESCRIPTION OF THE DRAWINGS

The features and advantages of the overhead camshaft engine according to the present invention will become more clearly appreciated from the following description taken in conjunction with the accompanying drawings, in which like reference numerals designate like or corresponding parts throughout in the several views and wherein.

DETAILED DESCRIPTION OF THE PREFERRED EMBODIMENTS

Figure 1:
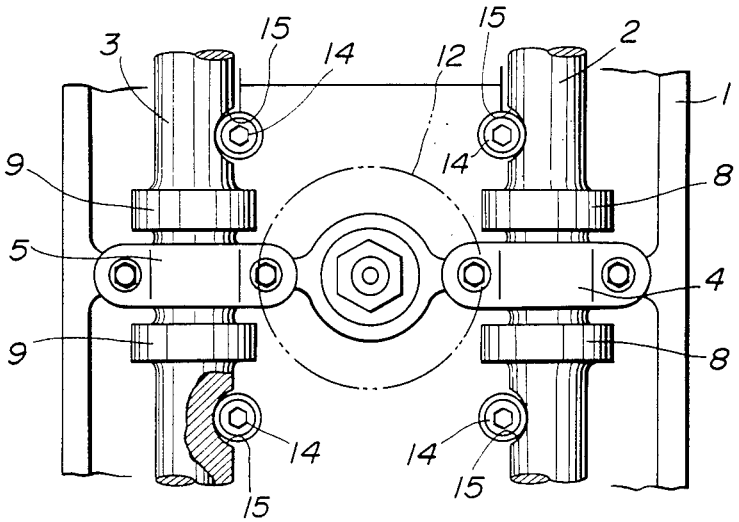
FIG. 1 is a fragmentary plan view of an overhead camshaft engine, according to an embodiment of the present invention.
Figure 2:
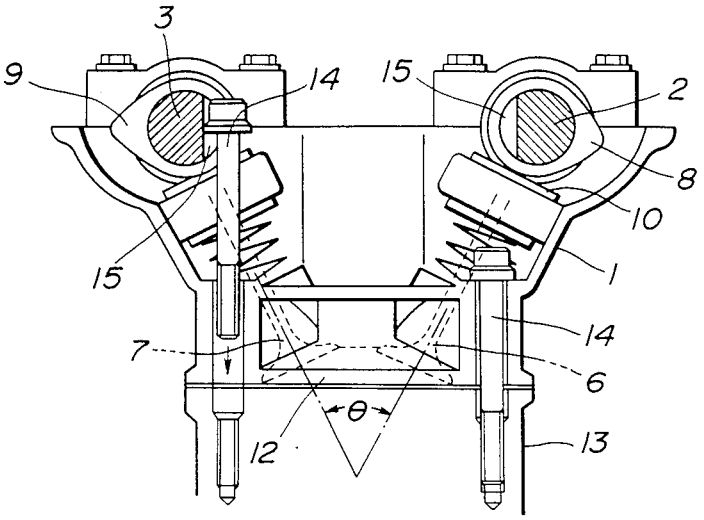
FIG. 2 is a sectional view of the overhead camshaft engine of FIG. 1.
Figure 3:
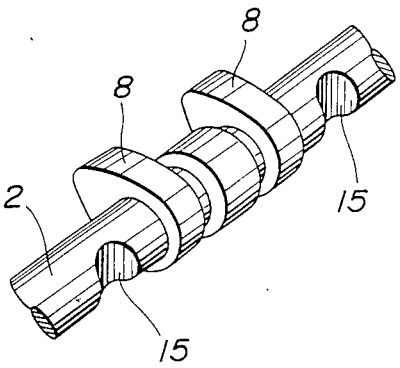
FIG. 3 is a fragmentary perspective view of a camshaft employed in the overhead camshaft engine of FIG. 1.

Referring first to FIGS. 1 through 3, two camshafts 2, 3 are arranged so close as to lie or lap in part over the head bolts 14 with respect to a plan view as shown in FIG. 1. The head bolts 14 are arranged between adjacent two cylinders 12 (though only one is shown) of a multi-cylinder engine and at equal intervals to fasten a cylinder head 1 to a cylinder block 3.

The camshafts 2, 3 are formed with notches or cuts 15 at the portions where they lap over the head bolts 14 in such a manner that the cuts of one camshaft respectively face to the cuts of the other camshaft when, for example, the piston in the first cylinder is at the top dead center on a compression stroke. In other words, the cuts 15 are respectively formed in the camshafts 2, 3 with a phase difference of 180°. The cuts 15 are formed to be of a semi-circular section according to the shape of the head bolts 14.

With the above arrangement, the head bolts 14 can be attached and detached even after installation of the camshafts 2, 3 to the cylinder head 1, provided that the camshafts 2, 3 are held at predetermined angular positions allowing the cuts 15 to be aligned with the head bolts 14.

In the foregoing, it is to be noted that since the two camshafts 2, 3, which are driven by a timing belt in timed relation to revolution of the engine, are respectively formed with the cuts 15 with a phase difference of 180°, unbalance of the camshafts 2, 3 due the cuts 15 is counterbalanced to eliminate vibrations thereof.

It is further to be noted that the engine can be reduced in the size directed to the width of the cylinder head 1 by the amount corresponding to the depth of the cut 15 by the amount of which the camshafts 2, 3 are arranged closer.

It is further to be noted that the provision of such cuts 15 makes it possible to reduce the included angle 8 between the axes of the intake and exhaust valves 6, 7, whereby to reduce the surface area of the combustion chamber 12 and improve the combustion efficiency.

Figure 4:
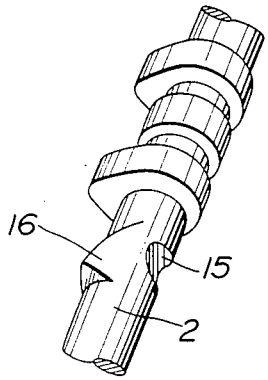
FIG. 4 is a view similar to FIG. 3 but showing a camshaft employed in a second embodiment of the present invention.

FIG. 4 shows another embodiment in which the camshafts 2, 3, though the camshaft 3 is not shown, are formed with padding-like projections 16 at the circumferential portions opposite to the cuts 15 with a view to preventing reduction in the rigidity and strength of the camshafts 2, 3 due to the provision of the cuts 15.

Figure 5:
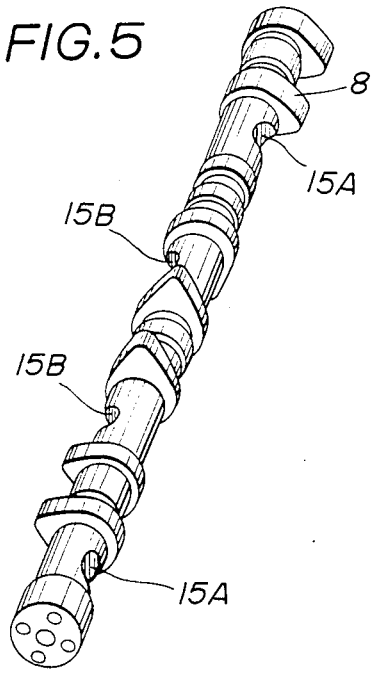
FIG. 5 is a perspective view of a camshaft employed in a third embodiment of the present invention.
Figure 6:
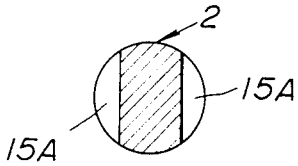
FIG. 6 is a sectional view of the camshaft of FIG. 5.
Figure 7:
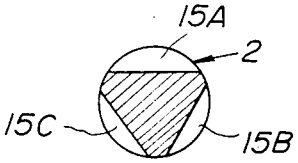
FIG. 7 is a sectional view of a camshaft employed in fourth embodiment of the present invention.
Figure 8:
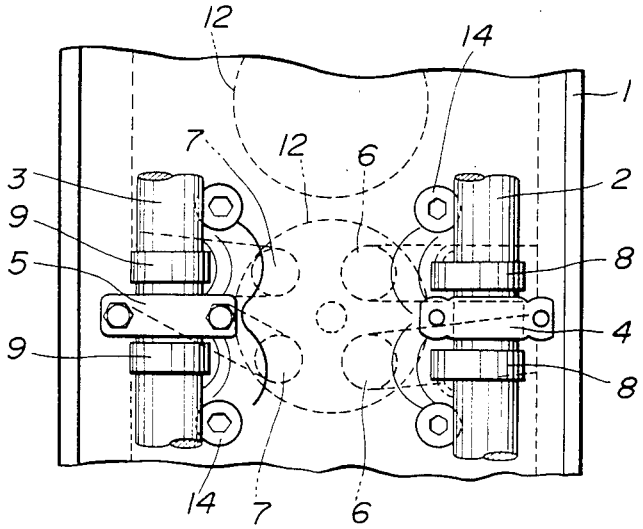
FIG. 8 is a fragmentary plan view of a prior art overhead camshaft engine.
Figure 9:
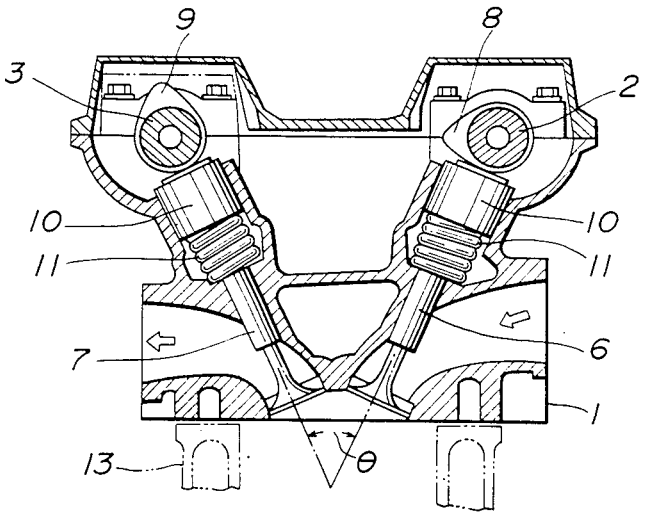
FIG. 9 is a sectional view of the prior art overhead camshaft engine of FIG. 8.

FIGS. 5 and 6 show a further embodiment in which with a view to balance in rotation the camshaft 2 when the engine is four-cylinder, the camshaft 2 is formed with the cuts 15A, 15B in such a manner that the cuts 15A for the first and fourth cylinders are formed at portions which are different in an angular position from that of the cuts 15B for the second and third cylinders by an angle of 180°, i.e., the cuts 15A, 15B are formed at angular intervals of 180° Though not shown, the camshaft 3 is formed with cuts 15A, 15B in the manner similar to the above. By this, each camshaft 2, 3 is balanced in rotation by itself, making it possible to eliminate vibrations more efficiently. In this instance, attachment and detachment of the head bolts 14 are made by changing the angular position of the camshafts 2, 3 by 180°

FIG. 6 shows a still further embodiment in which the camshaft 2 is adapted for use in a six-cylinder engine and formed with cuts 15A, 15B, 15C at angular intervals of 120°. Though not shown, the camshaft 3 is also formed with cuts 15A, 15B, 15C in the manner similar to the camshaft 2. By this, the camshafts 2, 3 cam be balanced by themselves to eliminate vibrations.

While the present invention has been described and shown as an application to a double overhead camshaft (DOHC) engine, this is not limitative and it may be applied to a single overhead camshaft (SOHC) engine of the kind wherein it is inevitable to arrange the camshaft in such a manner as to lap in part over the head bolts.

What is claimed is:

1. An overhead camshaft engine comprising:
   - a cylinder block;
   - a cylinder head;
   - a fastening member for fastening said cylinder head to said cylinder block;
   - a valve reciprocally mounted in said cylinder head; and
   - a camshaft rotatably mounted over said cylinder head to control reciprocation of said valve;
   - said camshaft being so arranged, with respect to a plan view, as to lap in part over said fastening member and formed with a peripheral cut at a portion where it laps over said fastening member to facilitate insertion and removal of said fastening member.

2. An overhead camshaft engine as set forth in claim 1, in which said camshaft is formed with a padding-like projection at a circumferential portion opposite to said cut.

3. An overhead camshaft engine as set forth in claim 1, in which said camshaft is further formed with a cut in such a manner that said first mentioned cut and said second mentioned cut are arranged at angular intervals of 180° when said engine is four-cylindered.

4. An overhead camshaft engine as set forth in claim 1, in which said camshaft is further formed with two cuts in such a manner that said first mentioned cut and said second mentioned cuts are arranged at angular intervals of 120° when said engine is six-cylindered.

5. An overhead camshaft engine as set forth in claim 1, further comprising a valve reciprocally mounted in said cylinder head, a fastening member for fastening said cylinder head to said cylinder block and spaced from said first mentioned fastening member in the direction transversing the axis of said camshaft, and a camshaft rotatably mounted over said cylinder head and parallely spaced from said first mentioned camshaft to control reciprocation of said second mentioned valve, said second mentioned camshaft being so arranged, with respect to a plan view, as to lap in part over said second mentioned fastening member and formed with a cut at a portion where it laps over said second mentioned fastening member, said first mentioned camshaft and said second mentioned camshaft being respectively formed with said first mentioned cut and said second mentioned cut with a phase difference of 180°.

* * * * *